US008225947B2

(12) United States Patent
Karp et al.

(10) Patent No.: US 8,225,947 B2
(45) Date of Patent: Jul. 24, 2012

(54) CRANE, IN PARTICULAR MOBILE CRANE WITH A NARROW TRACK AND ENLARGED SUPPORTING BASE

(75) Inventors: Günter Karp, Herschberg (DE); Fritz-Botho Köster, Rockenhausen (DE); Rüdiger Zollondz, Hornbach (DE); Alfons Weckbecker, Zweibrücken (DE)

(73) Assignee: Terex Demag GmbH, Zweibruecken (DE)

( * ) Notice: Subject to any disclaimer, the term of this patent is extended or adjusted under 35 U.S.C. 154(b) by 77 days.

(21) Appl. No.: 12/871,480

(22) Filed: Aug. 30, 2010

(65) Prior Publication Data

US 2010/0320166 A1 Dec. 23, 2010

Related U.S. Application Data

(62) Division of application No. 11/992,718, filed as application No. PCT/DE2006/001479 on Aug. 22, 2006.

(30) Foreign Application Priority Data

Sep. 28, 2005 (DE) ..... 10 2005 047 745

(51) Int. Cl.
*B66C 23/80* (2006.01)

(52) U.S. Cl. ..... 212/304; 212/301; 212/302; 212/303

(58) Field of Classification Search ..... 212/301–306
See application file for complete search history.

(56) References Cited

U.S. PATENT DOCUMENTS 527,741 A * 10/1894 Bennett ..... 212/303
2,131,479 A 9/1938 McGiffert et al.
2,139,960 A * 12/1938 Kauffman ..... 212/301
2,910,189 A * 10/1959 Scheuerpflug ..... 212/301
2,914,194 A 11/1959 Brown
3,021,016 A * 2/1962 Noll et al. ..... 212/304
3,878,944 A 4/1975 Beduhn et al.
4,196,816 A 4/1980 Dvorsky et al.
4,273,244 A * 6/1981 Jensen et al. ..... 212/181
4,387,814 A 6/1983 Beduhn et al.
4,394,911 A * 7/1983 Wittman et al. ..... 212/304
4,394,912 A 7/1983 Epps et al.
4,394,913 A 7/1983 Lanning et al.
4,446,976 A 5/1984 Imerman et al.

(Continued)

FOREIGN PATENT DOCUMENTS

DE 2364296 6/1975

(Continued)

OTHER PUBLICATIONS

Japanese Office Action dated Jan. 26, 2012 for JP Application No. 2008-532578, translation only.

*Primary Examiner* — Emmanuel M Marcelo
(74) *Attorney, Agent, or Firm* — Browdy and Neimark, PLLC

(57) ABSTRACT

A mobile crane includes an undercarriage with a middle section and two parallel crawler carriages; a superstructure on which a boom is mounted, the superstructure being connected to the undercarriage by a rotary joint; two longitudinal outriggers connected to the undercarriage and extending in the longitudinal direction between the crawler carriages; and two transverse outriggers connected to the undercarriage and extending outside the crawler carriages. One of the longitudinal outriggers has an end with a transverse beam supported by spaced apart outrigger cylinders which provide an extended tipping edge to further stabilize the crane.

15 Claims, 6 Drawing Sheets

U.S. PATENT DOCUMENTS

| | | | | |
|---|---|---|---|---|
| 4,723,667 | A * | 2/1988 | Zimmerman | 212/302 |
| 6,138,845 | A | 10/2000 | Kaspar | |
| 6,360,905 | B1 | 3/2002 | Frommelt et al. | |
| 6,588,521 | B1 * | 7/2003 | Porubcansky et al. | 180/9.1 |
| 6,848,522 | B2 * | 2/2005 | Moore et al. | 180/9.1 |
| 7,328,810 | B1 * | 2/2008 | Rhodes | 212/180 |
| 2002/0056694 | A1 | 5/2002 | Rode et al. | |

FOREIGN PATENT DOCUMENTS

| | | | |
|---|---|---|---|
| DE | 2517203 | | 10/1976 |
| DE | 129892 | | 2/1978 |
| DE | 3339863 | | 6/1984 |
| DE | 3310491 | | 10/1984 |
| DE | 10020270 | | 2/2001 |
| DE | 10143716 | | 3/2003 |
| EP | 0048076 | | 3/1982 |
| GB | 1554735 | A | 10/1979 |
| GB | 2135258 | | 8/1984 |
| JP | 60-009896 | U | 1/1985 |
| JP | 60-170392 | U | 11/1985 |
| JP | 4-31507 | A | 2/1992 |
| JP | 7-228485 | A | 8/1995 |
| WO | 1998/005581 | A2 | 2/1998 |

* cited by examiner

CRANE, IN PARTICULAR MOBILE CRANE WITH A NARROW TRACK AND ENLARGED SUPPORTING BASE

This is a divisional of application Ser. No. 11/992,718, filed May 20, 2008, which is the U.S. National Phase of International Application No. PCT/DE2006/001479 filed Aug. 22, 2006, which claims the benefits under §119 of Application No. 10 2005 047 745.3 filed in Germany on Jan. 12, 2007, the contents of each of which are incorporated herein.

BACKGROUND

1. Field

The invention pertains to a crane of the type having a superstructure connected to an undercarriage by a rotary joint, and outriggers which enlarge the support base.

2. Description of the Related Art

As a rule, cranes with rubber-tired travel carriages are equipped with outriggers (see FIG. 9). The lifting of loads is usually possible only when the crane is standing on the outriggers. Cranes with a crawler-type carriage usually do not have outriggers but rather lift loads while standing on the crawlers and can also usually travel while carrying the load. To obtain a wider support base, crawler-mounted cranes can also be equipped with outriggers. FIG. 10 shows the undercarriage of the Demag CC/PC 3800. The most important components are illustrated schematically in FIG. 11. The arrow 1 indicates the direction of travel. Four arms 4 extend from the center of rotation 2 to the crawlers 3. Four outriggers 5 are attached on the outside of the crawlers. A crane of this type can be operated either while standing on the crawlers or while standing on the outriggers. During operation on the outriggers, this arrangement is characterized by a direct flow of force, which is desirable. Nevertheless, the forces and moments must be transmitted through the crawlers 11. At the ends of the crawlers there are idler wheels, gearboxes, and crawler take-up devices. As a result, it is difficult to transmit the forces through at these points. FIG. 12 shows an undercarriage similar to that of FIG. 11. Here the crawlers are connected to each other by a middle section 6. This middle section represents the conventional design for a crawler-mounted crane without outriggers. There is usually sufficient room in the center of the crawler frame to make it relatively easy to install the components and to bolt them together. During operation on the outriggers, however, the forces are usually not distributed uniformly in the outriggers. As a result, torque is created in the middle section 6 and also in the crawlers 3. In FIG. 13, not only the middle section 6 but also the outriggers 7 are attached to the centers of the crawlers. This relieves the crawlers 3 of load.

SUMMARY

The invention is based on the task of equipping a crane, especially a mobile crane on a narrow crawler-type carriage, with outriggers in such a way that an extended support base is obtained.

This task is accomplished by a crane, especially a mobile crane, having an undercarriage and a superstructure, on which a boom is mounted, where the superstructure is connected to the undercarriage by a rotary joint, and where several outriggers are provided on the crane to increase the size of the support base. The undercarriage includes a middle section and two parallel crawler-type carriages, one on each side of the middle section. Four outriggers are provided, which are connected to the undercarriage, where their orientation is fixed in such a way that each one forms a 90° angle to the other, and where two of the outriggers are oriented in the longitudinal direction of the undercarriage and two are oriented transversely to it.

As a result of the arrangement of the outriggers in the longitudinal direction and in the direction transverse to the undercarriage, a direct flow of force is obtained. As a result, there are no avoidable torques. The forces and stresses which occur are smaller. Less material is required. Weight and costs are reduced. In addition, the points at which the outriggers are connected to the travel carriage are always at right angles. Outriggers can usually be attached more easily and more quickly at a right angle than at a slant. The amount of space occupied by the connection is also smaller.

The outriggers are preferably arranged parallel to the crawlers and perpendicular to the crawlers, and they intersect at the center of rotation. The concrete design can deviate from this. The point is, however, that the ends of the outriggers which are transverse to the travel direction lie outside the track and that the outriggers which are oriented in the travel direction are located inside the track.

According to one embodiment, the outriggers can be attached to the undercarriage in that at least one of the transversely oriented outriggers is attached directly to a crawler-type carriage.

It is also possible for the bottom surface of one of the lateral outriggers to be attached to the facing side of the crawler-type carriage and for the top surface to be attached to the middle section.

The longitudinally oriented outriggers can be attached directly to the middle section or to the side of the crawler-type carriage facing the middle section or to both the middle section and the crawler-type carriage.

According to another embodiment, the outriggers can be designed to telescope and to have the capacity to be folded up or to the side.

Extendable outrigger cylinders, which establish contact with the support surface, are mounted at the ends of the outriggers.

A special embodiment which is advantageous both for stationary and for mobile cranes includes at least one outrigger designed as a tipping edge standing on two points.

To accomplish this, a transverse beam can be attached to the end of the outrigger, and two outrigger cylinders can be mounted on the transverse beam a certain distance apart.

The outrigger cylinders can be extended either hydraulically or by means of spindle drives.

Finally, an additional outrigger cylinder can be mounted on the end of the outrigger in the center between the two outrigger cylinders mounted on the transverse beam.

The outrigger cylinders, according to another embodiment, can be connected at their free ends to an outrigger pad by way of ball joints, and it is possible for one of the outrigger cylinders mounted on the transverse beam to be supported on the beam with freedom to rotate around an axis transverse to its longitudinal axis to exclude any possible straining forces.

BRIEF DESCRIPTION OF THE DRAWINGS

The invention is explained in greater detail below on the basis of the drawings.

DETAILED DESCRIPTION

Figure 1:
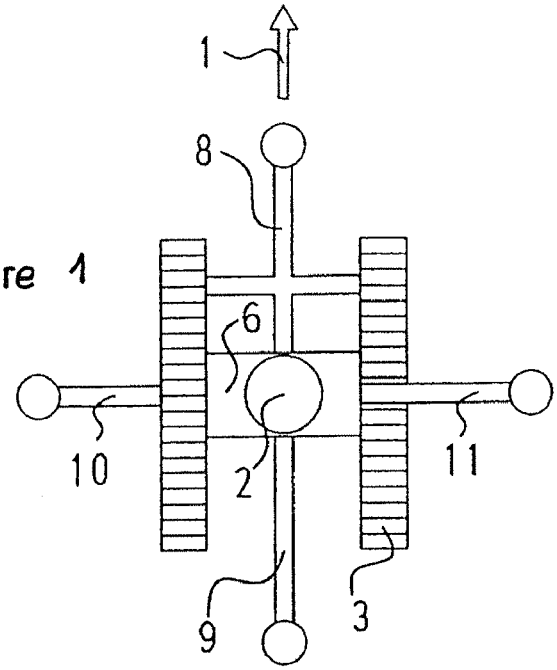
FIG. 1 shows a top view of the crawler-type carriage with outriggers.

According to the invention (FIG. 1), the crane has 4 outriggers. Looking in the travel direction, one outrigger 8 points forward and lies inside the track. One outrigger 9 points to the rear and lies inside the track. One outrigger 10 points to the left and lies outside the track. One outrigger 11 points to the right and lies outside the track. In this arrangement, all the outriggers are subjected purely to bending. The middle section 6 and the crawlers 3 are not subject to torsion either. The outriggers 8-11 are connected to the crawlers 3 and to the middle section 6 at right angles in areas where there is plenty of room to work.

Figure 2:
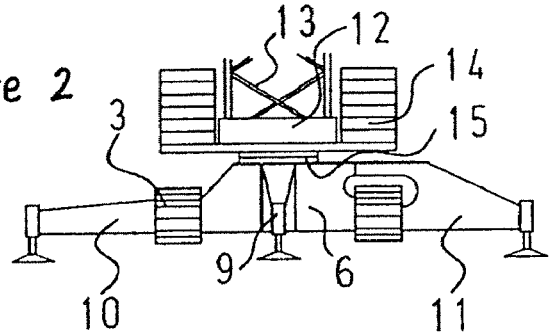
FIG. 2 shows a view from the rear.

FIG. 2 shows an inventive crane from the rear. The superstructure 12 with the boom 13 and the counterweight 14 is connected rotatably to the middle section 6 by a rotary joint 15. With this arrangement, as can be seen in FIG. 2, the outriggers can be relatively long, as a result of which strong moments develop in the outriggers. Because the left outrigger 10 passes through the crawler 3, the height of the outrigger 10 is limited by the height of the crawler.

The way in which the right outrigger 11 is attached eliminates this restriction. The bottom surface of the outrigger 11 is connected to the right crawler. The top surface is fastened to the middle section 6. It is also possible for the outrigger to be attached only to the middle section 3. In this case, there no need for any modifications to the crawler. If the outriggers 10, 11 are connected to the middle section, this connection must be located between the rotary joint and the connections to the crawlers. The rear outrigger 9 is attached only to the middle section. To reduce the moment in the outrigger, it, like the forward outrigger 8, can be attached both to the middle section and to the crawlers. Of course, it is also possible to attach the outriggers 8, 9 only to the crawlers.

Figure 3:
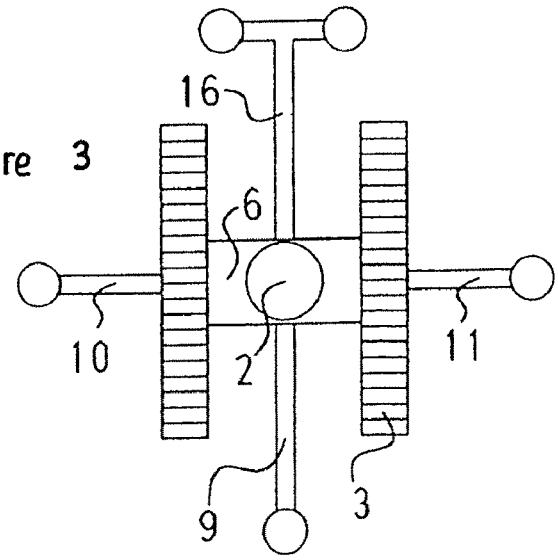
FIG. 3 shows a modified design of the outriggers with tipping edge.
Figure 4:
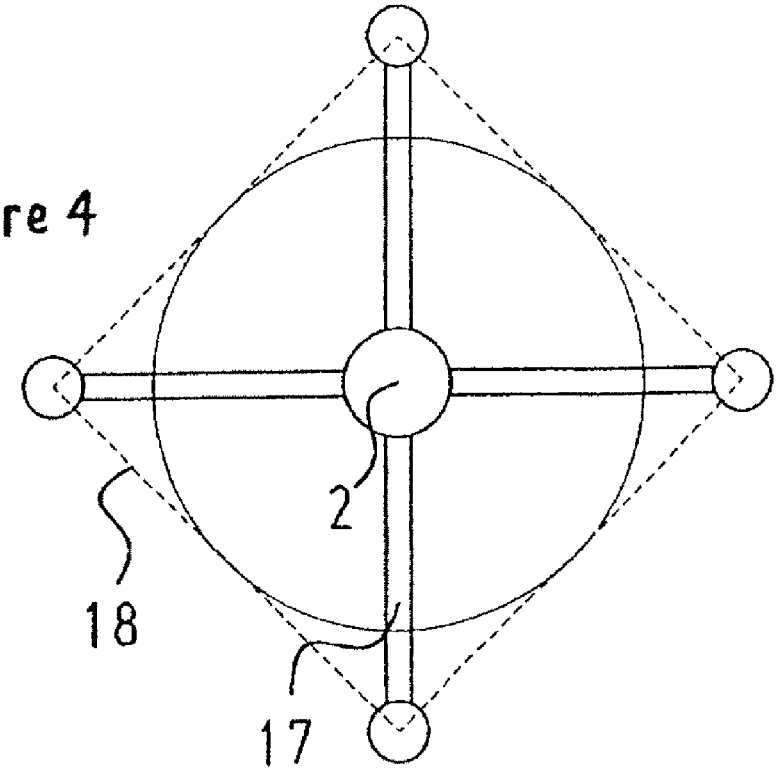
FIGS. 4 and 5 explain the tipping edge.
Figure 5:
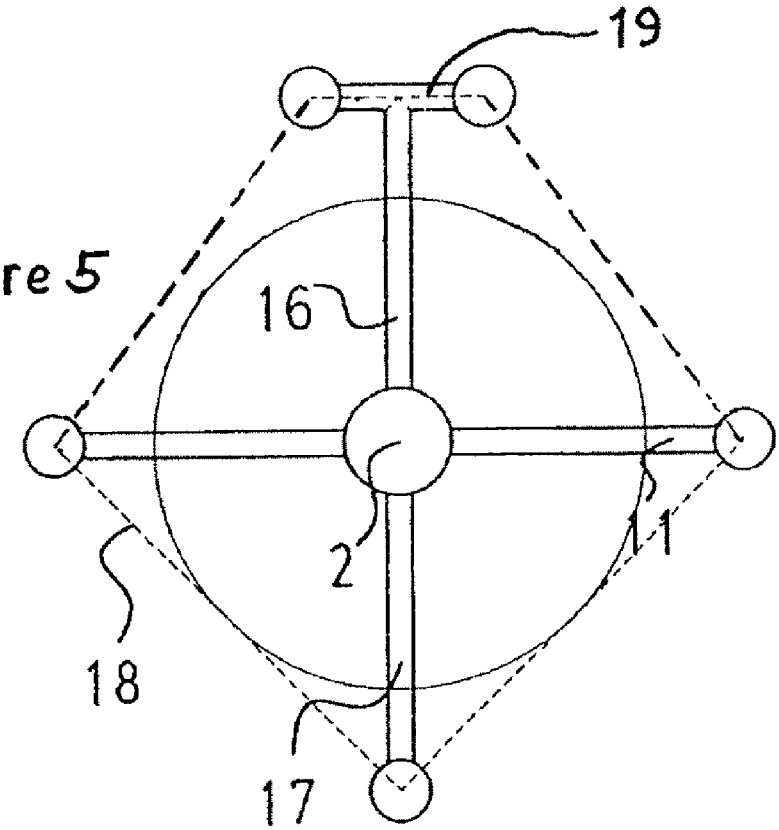

FIG. 3 shows another advantageous embodiment. One outrigger 16 is designed so that a tipping edge is formed on the outrigger. The advantage will be explained on the basis of FIGS. 4 and 5. In FIG. 4, 4 outriggers 17 are illustrated schematically, which are arranged on a circle centered on the center of rotation 2. The connecting line 18 between the ends of two adjacent outriggers is referred to as the "tipping edge" 18. If the crane were to lose its stability (accident), it would tip over this edge 18. If an outrigger 16 (FIGS. 4 and 5) is designed so that it stands on 2 points, a tipping edge 19 is formed, which is farther away from the center of rotation than the conventional tipping edges 18. When the boom is standing over this outrigger, therefore, the load moment is higher. This higher load moment can be used to carry out especially heavy lifts or to raise especially long booms from the ground.

Figure 6:
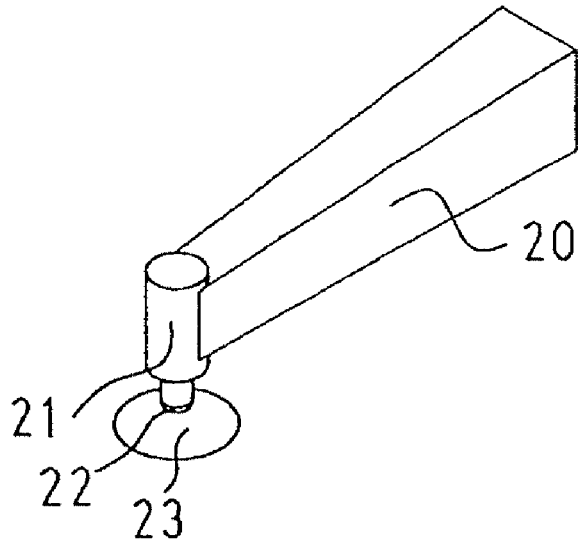
FIGS. 6-8 show designs of an outrigger.
Figure 7:
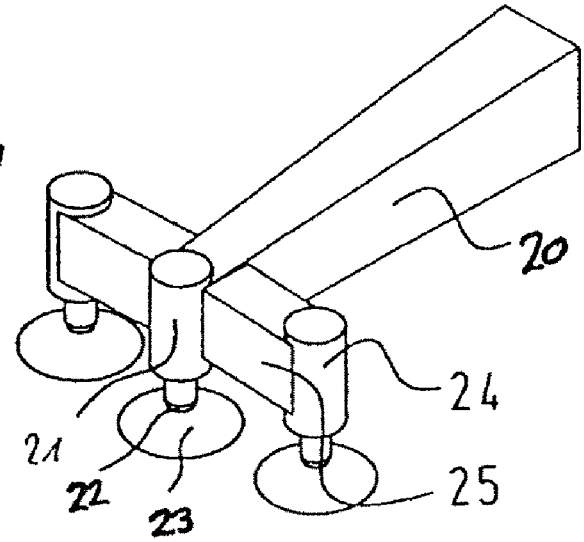
Figure 8:
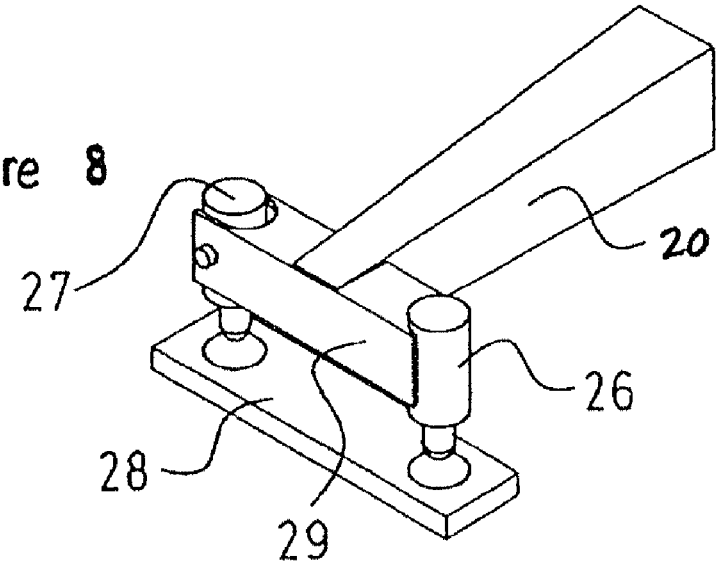
Figure 9:
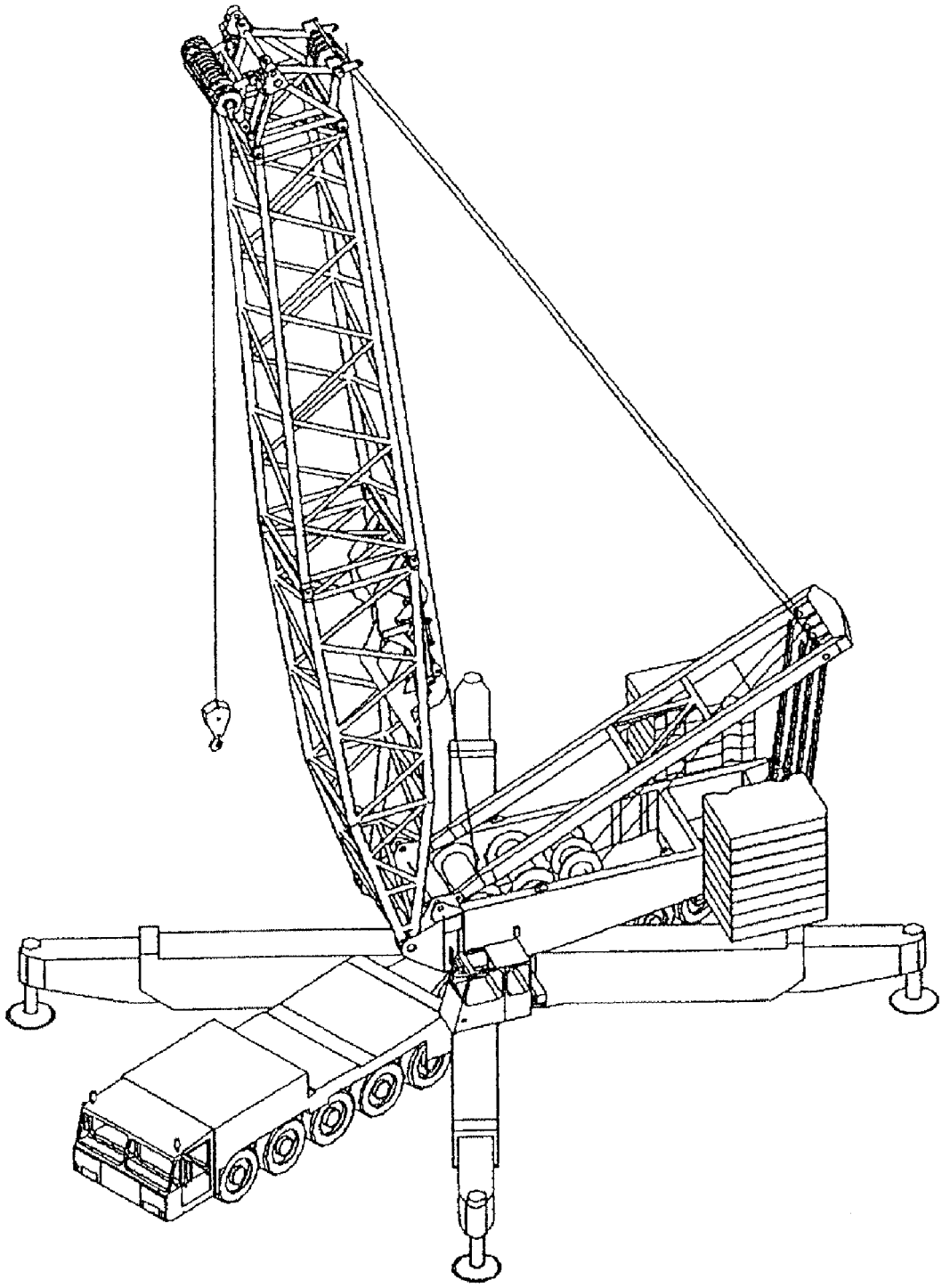
Figure 9 (PRIOR ART)
FIGS. 9-13 show diagrams of the prior art.
Figure 10:
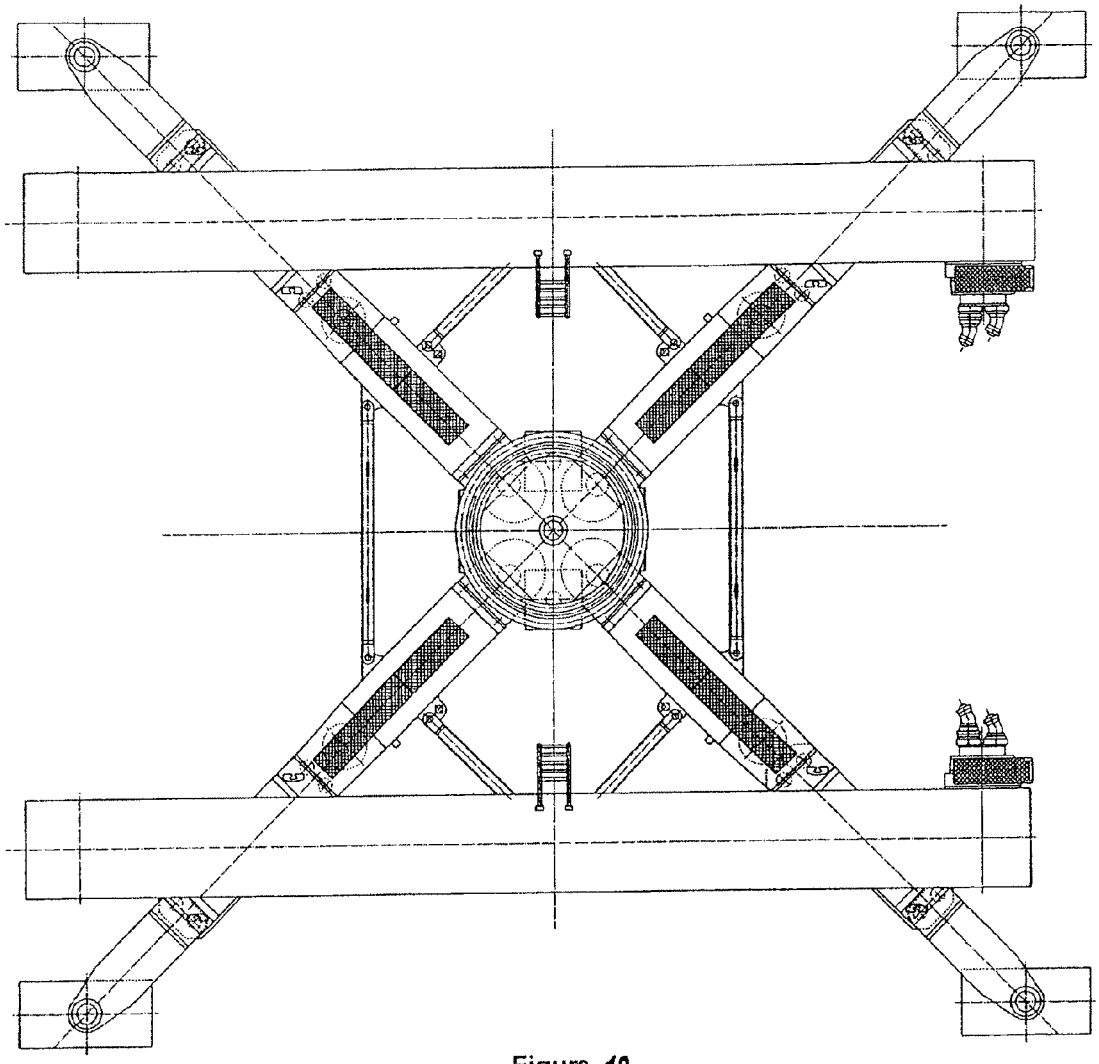
Figure 10 (PRIOR ART)
Figure 11:
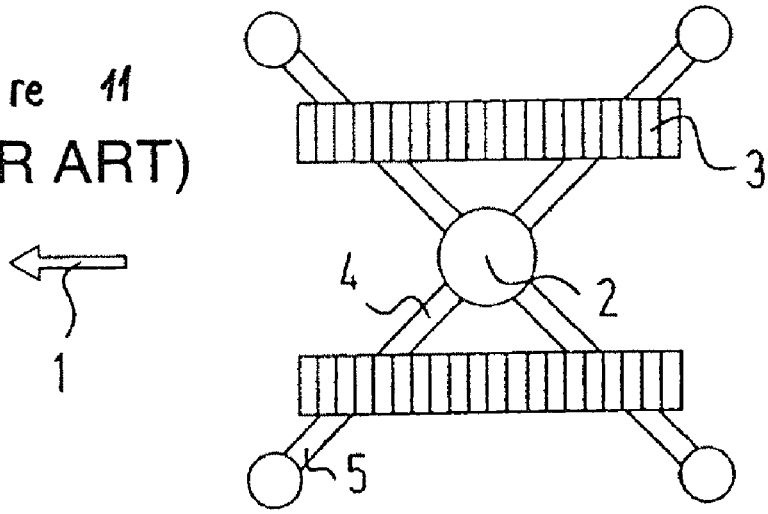
Figure 11 (PRIOR ART)
Figure 12:
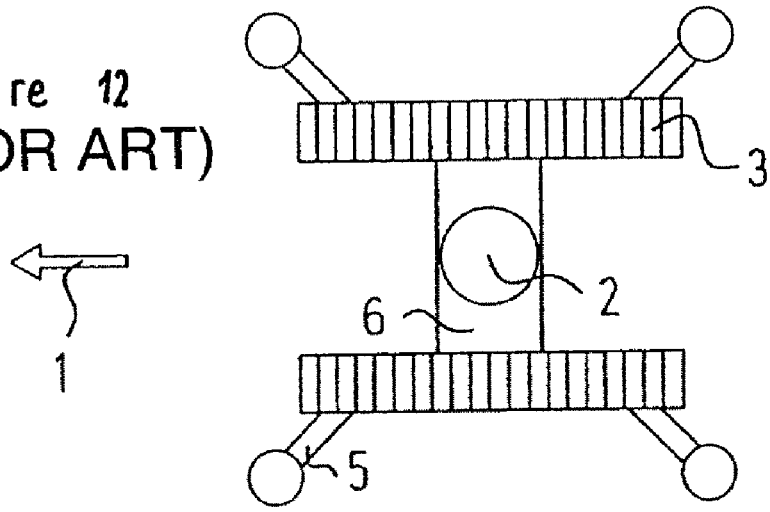
Figure 12 (PRIOR ART)
Figure 13:
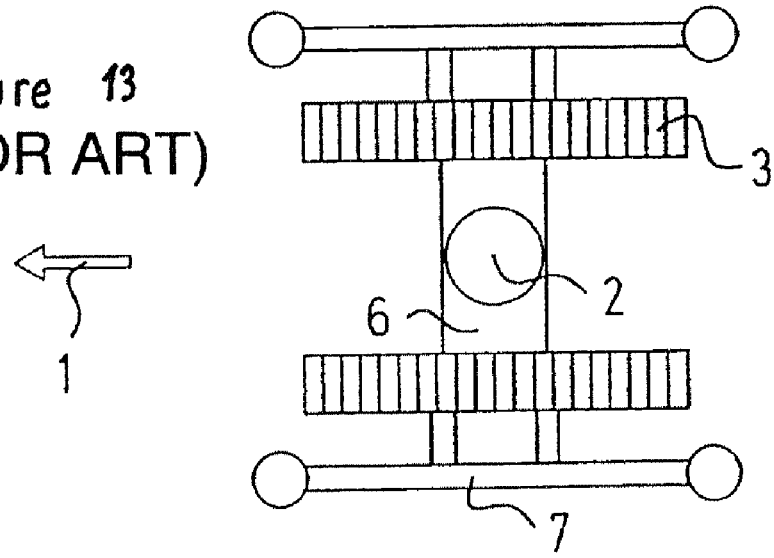
Figure 13 (PRIOR ART)

Other possible embodiments of these types of outriggers will be explained on the basis of FIGS. 6, 7, and 8. FIG. 8 shows a typical conventional outrigger. A hydraulic cylinder 21, which is connected to an outrigger plate 23 by means of a ball joint 22, is attached to the end of the outrigger support beam 20. The ball joint compensates for small irregularities in the surface of the ground. An inventive outrigger must have a tipping edge at its end. One possible design (FIG. 7) consists of a central outrigger with an outrigger cylinder 21 and two additional outrigger cylinders 24, which are mounted laterally on a transverse beam 25 attached to the end of the outrigger support beam 20. During normal operation of the crane, the middle outrigger cylinder 21 will be used. To activate the additional tipping edge, the lateral outrigger cylinders 24 are extended. This can be done hydraulically or by means of spindle drives. Fold-away or plug-in outriggers are also possible. FIG. 8 shows another embodiment. In the forward area, two lateral outrigger cylinders 26, 27 are mounted on a transverse beam 29. They are connected to an outrigger pad 28 by ball joints. To exclude the possibility of straining forces, one of the cylinders 27 is mounted rotatably in the transverse beam 29. When the additional tipping edge is activated, hydraulic oil is trapped in the cylinders. The arrangement is then rigid. During normal operation of the crane (on the standard support base), the cylinders are connected hydraulically in series, so that oil can flow unhindered from one cylinder to the other. Thus the outrigger pad can rotate around a point between the cylinders. This possibility of being able to switch between normal operation and operation with an extended tipping edge is not absolutely necessary. Nevertheless, it ensures that the pressure under the outrigger pad (28) is distributed uniformly over the ground.

What is claimed is:

1. A mobile crane comprising:

an undercarriage comprising a middle section and two parallel crawler carriages defining a longitudinal direction;

a superstructure on which a boom is mounted, the superstructure being connected to the undercarriage by rotary joint having a center of rotation; and at least four outriggers arranged around the center of rotation, at least one of said outriggers having a first end with which said outriggers are attached to the undercarriage of the crane and having a second end opposed to said first end having at least two support points, said at least two support points having a first end and a second end, said first end of said at least two support points being rigidly connected to said second end of said at least of said outriggers, wherein said outriggers stand on said second end of said at least two support points, and said first end of said at least two support points have a connecting line which forms a tipping edge.

2. The mobile crane of claim 1 comprising a transverse beam transversely attached to the second end of the at least one of said outriggers, and a pair of spaced apart outrigger cylinders laterally mounted on the transverse beam, wherein the transverse beam is supported by said outrigger cylinders on the ground.

3. The mobile crane of claim 2 wherein the outrigger cylinders are extended hydraulically.

4. The mobile crane of claim 2 wherein the outrigger cylinders are extended by spindle drives.

5. The mobile crane of claim 2 further comprising a central outrigger cylinder between the spaced apart outrigger cylinders.

6. The mobile crane of claim 2 wherein one of said outrigger cylinders is mounted to said transverse beam with freedom of rotation about an axis transverse to the longitudinal axis of the cylinder, wherein the freedom of rotation of said outrigger cylinder is blocked for activation of the tipping edge.

7. The mobile crane of claim 1 wherein the tipping edge is farther away from the center of rotation than a tipping edge formed by each second end of the at least four outriggers.

8. A mobile crane comprising:

an undercarriage comprising a middle section and two parallel crawler carriages defining a longitudinal direction;

a superstructure on which a boom is mounted, the superstructure being connected to the undercarriage by rotary joint having a center of rotation;

at least four outriggers arranged around the center of rotation, at least one of said outriggers having a first end with which said outriggers are attached to the undercarriage of the crane and having a second end opposed to said first end having at least two support points, said at least two support points having a first end and a second end, said first end of said at least two support points being rigidly connected to said second end of said at least one of said outriggers, wherein said at least one of said outriggers stands on said second end of said at least two support points;

a transverse beam forming a tipping edge transversely attached to the second end of the at least one of said outriggers and to said first end of said at least two support points, and a pair of spaced apart outrigger cylinders laterally mounted on the transverse beam, wherein the transverse beam is supported by said outrigger cylinders on the ground; and at least one outrigger pad connected to at least one of said outrigger cylinders of the transverse beam by ball joints.

9. The mobile crane of claim 8 wherein the outrigger cylinders are extended hydraulically.

10. The mobile crane of claim 8 wherein the outrigger cylinders are extended by spindle drives.

11. The mobile crane of claim 8 further comprising a central outrigger cylinder between the spaced apart outrigger cylinders.

12. The mobile crane of claim 8 wherein one of said outrigger cylinders is mounted to said transverse beam with freedom of rotation about an axis transverse to the longitudinal axis of the cylinder, wherein the freedom of rotation of said outrigger cylinder is blocked for activation of the tipping edge.

13. The mobile crane of claim 8 wherein the tipping edge is farther away from the center of rotation than a tipping edge formed by each second end of the at least four outriggers.

14. The mobile crane of claim 8 wherein only a single outrigger pad is connected to all of said outrigger cylinders of the transverse beam.

15. A mobile crane comprising:

an undercarriage comprising a middle section and two parallel crawler carriages defining a longitudinal direction;

a superstructure on which a boom is mounted, the superstructure being connected to the undercarriage by rotary joint having a center of rotation;

at least four outriggers each having a first and attached to the undercarriage of the crane and each having a second end opposed to the first end, wherein the second ends are arranged on a circle centered on the center of rotation and wherein the second end of at least one outrigger has at least two support points each having a first and second end, the first end of said at least two support points rigidly connected to the second end of the at least one outrigger, wherein said at least one outrigger stands on the second end of said at least two support points which define a tipping edge, which is outside said circle.

* * * * *